United States Patent [19]

Baigent Maurice G.

[11] Patent Number: 4,695,169

[45] Date of Patent: Sep. 22, 1987

[54] STRUCTURAL BEARING

[75] Inventor: Baigent Maurice G., Somerset, England

[73] Assignee: AEPLC, Rugby, England

[21] Appl. No.: 818,327

[22] Filed: Jan. 13, 1986

[30] Foreign Application Priority Data

Jan. 14, 1985 [GB] United Kingdom ..... 8500822

[51] Int. Cl.[4] ..... F16C 41/00; F16C 27/06; E01D 19/04

[52] U.S. Cl. ..... 384/36; 384/37; 14/16.1

[58] Field of Search ..... 384/36, 37; 14/16.1

[56] References Cited

U.S. PATENT DOCUMENTS 3,782,789 1/1974 Koester ..... 14/16.1 X
3,908,054 9/1975 Ito ..... 14/16.1 X
3,938,852 2/1976 Hein et al. ..... 14/16.1
4,006,505 2/1977 Köster ..... 384/36 X

FOREIGN PATENT DOCUMENTS 1179978 10/1964 Fed. Rep. of Germany ..... 14/16.1

*Primary Examiner*—Stuart S. Levy
*Assistant Examiner*—Thomas R. Hannon
*Attorney, Agent, or Firm*—Price, Heneveld, Cooper, DeWitt & Litton

[57] ABSTRACT

A structural bearing assembly in which a center plate is located upon a support 11. The support comprises an elastomeric core and a reinforcing outer layer 13 made up of a spirally wound cord of KEVLAR material embedded in a matrix of an elastomeric material which may or may not be the same as that of the core.

18 Claims, 5 Drawing Figures

STRUCTURAL BEARING

BACKGROUND OF THE INVENTION

The present invention relates to structural bearings, in particular, self-aligning supports for structural bearings.

One generally known self-aligning support is the so-called "Rubber Pot" bearing in which a rubber or elastomeric pad is enclosed and sealed within a cylinder or retaining ring. Under load, the rubber acts as a fluid to provide alignment. However, this construction tends to be rather expensive, requiring close tolerances in manufacture.

In another known construction an unrestrained and unenclosed elastomeric disc is attached between two plates. Resistance to horizontal loads is provided by a rod passing through the disc and located in the two plates. However, in such an unenclosed construction, the elastomeric pad requires to be quire hard in order to provide the necessary load-bearing capacity. This limits the rotational capacity available due to high moments of resistance which in turn create unduly high edge stresses on the interfaces.

SUMMARY OF THE INVENTION

It is an object of the present invention to provide a structural bearing support which is inexpensive and which is capable of a high load bearing capacity while at the same time offering a high rotational capacity.

It is a further object of the invention to provide a construction in which wear is minimised and in which sealing is not a problem.

According to the invention, a structural bearing includes a support comprising an elastomeric core having an integral outer reinforcing layer.

Preferably, the reinforcing layer includes wound fibres or a wound cord which may be moulded in a similar elastomeric material to the core and preferably encloses the core. Preferably, the fibres are of a material known by the Trademark KEVLAR, a trademark of E. I. DuPont de Nemours for the fibre poly (p-phenyleneterephthalamide) or carbon fibre or steel and are present as a spirally wound cord.

The elastomeric material may be any known synthetic material such as neoprene or polyethylene but is preferably a natural or synthetic rubber.

The support may simply be located between upper and lower plates and it is therefore not necessary to machine out accurately the centre of a retaining ring as is necessary in the case of the Pot bearing. Thus, there are no associated sealing problems.

Furthermore, since the reinforcement effectively restrains the tendency for the elastomer to bulge under load, rotational stiffness can be varied without affecting the load capacity, and the choice of elastomer need not be determined by its load capacity but possibly by some other property, for example resistance to chemical attack.

Finally, a support as described can be manufactured relatively cheaply, simply by winding a Kevlar cord coated with an elastomer around an elastomeric core. The elastomer can also be moulded between and/or around the Kevlar winding.

DESCRIPTION OF THE PREFERRED EMBODIMENTS.

Figure 1:
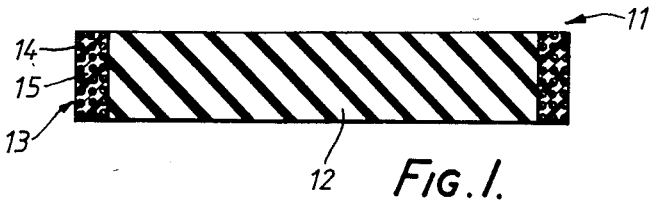
FIG. 1 is a schematic section through a support in accordance with the invention.

As shown in FIG. 1, a support 11 for a structural bearing comprises a core 12 of an elastomeric material such as natural rubber and a reinforcing outer layer 13 enclosing the core 12. The outer layer 13 is made up of a spirally wound cord 14 of Kevlar embedded in a matrix 15 of an elastomeric material which may or may not be the same as that of the core 12.

Figure 2:
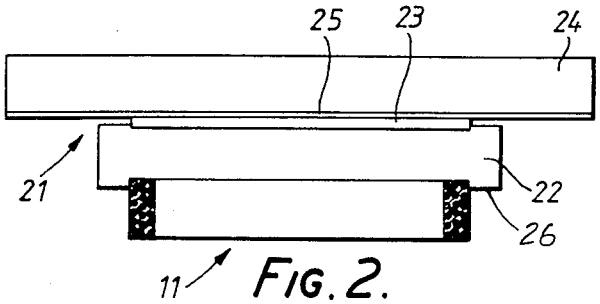
FIG. 2 is a schematic section through one form of structural bearing using the support of FIG. 1.
Figure 3:
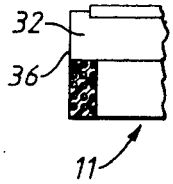
FIG. 3 is a variation on the form shown in FIG. 2.

FIG. 2 shows a free structural bearing 21 in which a support 11 is fixed beneath a centre plate 22 having a bearing layer 23 of for example polytetrafluoroethylene (PTFE). Above the centre plate there is a sliding plate 24 having a contact surface 25 of for example stainless steel co-operating with the bearing surface 23. The centre plate 22 has a downturned peripheral shoulder 26 which encloses the support 11, however, in the variation shown in FIG. 3, the core 11 is flush with the peripheral edge 36 of the centre plate 32 and is bonded to it.

Figure 4:
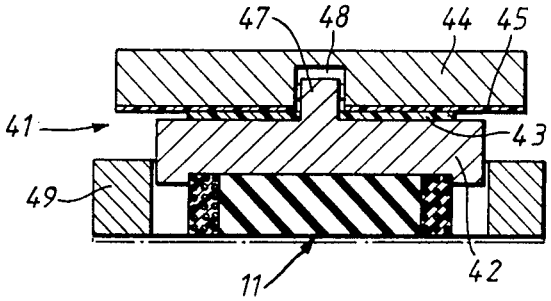
FIGS. 4 and 5 are views similar to FIG. 2 showing two further embodiments of structural bearings.

FIG. 4 shows a guided structural bearing 41 in which the support 11 is fixed beneath a centre plate 42 having a bearing layer 43 co-operating with the contact surface 45 of a sliding plate 44. However, in this case, the centre plate 42 has a central guide 47 which is located in a corresponding recess 48 in the sliding plate 44, providing a sliding key. Furthermore, horizontal movement is restrained by an outer wall 49 (or restraining ring) which encloses the support 11 and the centre plate 42.

Figure 5:
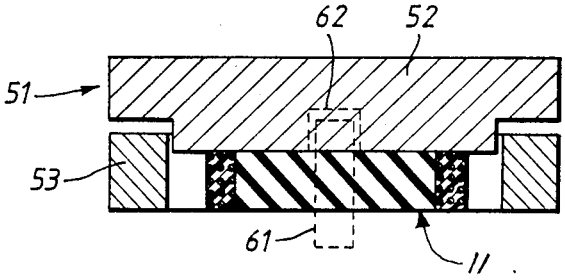

FIG. 5 shows a fixed structural bearing 51 in which the support 11 is fixed directly to the underside of a structural support member 52. The support member is guided for vertical movement by an outer wall 53 and all sliding movements are prevented.

In FIGS. 4 and 5 the wall 49, 53 may be replaced by a dowel 61 or shear pin (not shown) extending through the support 11 into a corresponding recess 62 in the centre plate 42 or the support member 52, as a free fit. Also, in these two embodiments, the support 11 and walls 49, 53 may be fixed directly to the substructure or there may be a sheet located immediately above the substructure to prevent concrete etc. entering working parts of the bearing.

Obviously, numerous modifications and variations of the present invention are possible in the light of the above teachings. It is therefore to be understood that within the scope of the appended claims, the invention may be practiced otherwise than as specifically described herein.

I claim:

1. A structural bearing assembly having a self-aligning support comprising: an elastomeric core support element, an annular reinforcement member surrounding said support element and integrally joined thereto; said member having a plurality of windings of tension resistant material in fibre form embedded in a matrix of an elastomeric material, said reinforcement member extending vertically from the top to the bottom of said support element and with said reinforcement member providing a free standing flexibly resilient support resistant to deformation in the form of lateral expansion.

2. A support according to claim 1 wherein said fibres are moulded in a similar elastomeric material to that of said core.

3. A support according to claim 1 wherein said fibres of said reinforcement member are composed of a material selected from the group of materials consisting of carbon fibres, steel and poly (p-phenyleneterephthalamide).

4. A support according to claim 3 wherein said fibres of said reinforcement member include a spirally wound cord.

5. A support as described in claim 3 wherein said fibres are spirally wound.

6. A support according to claim 1 wherein said reinforcement member includes a spirally wound cord.

7. A support as claimed in claim 1 wherein said elastomeric material of said core support element is a material selected from the group consisting of neoprene, polyethylene and natural rubber.

8. A support as described in claim 7 wherein said matrix of said reinforcement member is of the same material as said core support element.

9. A support as described in claim 1 wherein said tension resistant material is poly (p-phenyleneterephthalamide).

10. A support as described in claim 1 wherein said core support element is rubber.

11. A structural bearing assembly having vertically spaced upper and lower plates and a self-aligning support positioned between and engaging both of said plates, said support having a central core of elastomeric material and an annular reinforcement member surrounding and integrally joined to said central core and engaging both of said plates, said member being an annulus of windings of a tension resistant fibre embedded in an elastomeric matrix capable of torsional twisting and bending about its central axis without any lateral enlargement due to axially imposed loads.

12. A structural bearing assembly as described in claim 11 wherein said support is circular and substantially all of the vertical exterior surface of said support is free standing and without lateral contact whereby said support is capable of limited rotational deflection.

13. A structural bearing assembly as described in claim 12 wherein said core is bonded to said upper plate.

14. A structural bearing assembly as described in claim 12 wherein said upper plate has a shallow recess in its lower face surrounded by a dependent lip, the upper edge of said support being seated in said recess.

15. A structural bearing assembly as described in claim 12 wherein said upper plate extends laterally outwardly beyond said support; a wall spaced from and surrounding both said support and said upper plate forming a restraining ring for limiting lateral movement of said upper plate with respect to said base.

16. A structural bearing assembly as described in claim 12 wherein said elastomeric material of said core is a material selected from the group consisting of neoprene, polyethylene and natural rubber.

17. A stuctural bearing assembly as described in claim 16 wherein the fibres of said reinforcement member are composed of a material selected from the group of materials consisting of carbon fibres, steel and poly (p-phenyleneterephthalamide).

18. A structural bearing assembly including a self aligning support located between an upper plate and a lower plate, said support comprising an elastomeric core of neoprene, said core having an integral outer reinforcing layer, said outer reinforcing layer comprising a spirally wound cord of poly (p-phenyleneterephthalamide) material embedded in an elastomeric material.

* * * * *